United States Patent [19]

Uehara

[11] 4,224,975

[45] Sep. 30, 1980

[54] SWIVEL ROLLER ASSEMBLY FOR FOLDING DOORS

[75] Inventor: Takeo Uehara, Uozu, Japan

[73] Assignee: Yoshida Kogyo K.K., Tokyo, Japan

[21] Appl. No.: 968,802

[22] Filed: Dec. 12, 1978

[30] Foreign Application Priority Data

Dec. 29, 1977 [JP] Japan ..... 52-176286

[51] Int. Cl.[3] ..... E05D 15/26

[52] U.S. Cl. ..... 160/206

[58] Field of Search ..... 160/118, 199, 206

[56] References Cited

U.S. PATENT DOCUMENTS

| | | | |
|---|---|---|---|
| 688,509 | 12/1901 | Butterfield | 160/206 |
| 2,075,716 | 3/1937 | Harrison | 160/206 |
| 2,989,788 | 6/1961 | Kessler | 160/381 |
| 3,298,425 | 1/1967 | Cayton et al. | 160/176 |
| 3,605,852 | 9/1971 | Vecchiarelli | 160/176 |

*Primary Examiner*—Peter M. Caun

*Attorney, Agent, or Firm*—Hill, Van Santen, Steadman, Chiara & Simpson

[57] ABSTRACT

A swivel roller assembly to be mounted at the bottom end of a folding door stile which is movable in the plane of a doorframe during the opening and closing of the door. The roller assembly comprises a hollow outer member to be immovably fitted in the bottom end of the stile, a hollow inner member rotatably received in the outer member and adapted to be mounted astride the sill rail of the doorframe, and a roller rotatably mounted within the inner member for rolling engagement with the sill rail. The outer member bears on the inner member via a bearing washer, as of stainless steel, for swivelling motion relative to same.

6 Claims, 8 Drawing Figures

SWIVEL ROLLER ASSEMBLY FOR FOLDING DOORS

BACKGROUND OF THE INVENTION

1. Field of the Invention

This invention pertains to a folding door which is opened and closed by folding and unfolding a plurality of door sections. More specifically, the invention is directed to an improved swivel roller assembly for use in such a folding door.

2. Description of the Prior Art

In a folding door of the type under consideration, two or more door sections or panels are usually hinged together. One of the stiles of the door is further hinged to one of the side jambs so that the several door sections may be disposed in coplanar relationship to each other in the plane of the doorframe when the door is closed. In opening or closing the door, the other, opening side stile is required to move in the doorframe plane as guided by the header and sill tracks of the doorframe.

Usually, the opening side stile of the folding door is equipped with roller assemblies at its top and bottom ends for rolling engagement with the header and sill tracks. The roller assembly at the top of the stile can be in the form of a simple roller mounted on an upstanding pivot pin. The roller assembly at the bottom, however, must be of sturdier build as it is required to bear the vertical load of the folding door; nevertheless, the bottom roller assembly must be capable of rolling smoothly along the sill track while permitting easy swivelling motion of the opening side stile.

It has been known to incorporate a ball bearing or the like in such a bottom roller assembly. This known roller assembly is objectionable because of its expensiveness, among other reasons.

SUMMARY OF THE INVENTION

It is among the objects of this invention to provide an improved swivel roller assembly which is materially simplified and inexpensive but sturdy and durable in construction, which can be readily installed in place on a folding door, and which is capable of rolling smoothly along a predetermined track while permitting easy swinging motion of one of the folding door sections mounted thereon.

The invention is specifically directed to a swivel roller assembly for a folding door of the type having a plurality of foldable door sections mounted within a doorframe, with one of the door sections having a stile which is movable in the plane of the doorframe during the opening and closing of the door. The swivel roller assembly is intended to be mounted at the bottom end of this stile for moving same along a rail on the sill of the doorframe while permitting the swivelling motion of the stile.

Briefly, the swivel roller assembly comprises a hollow outer member adapted to be immovably received in the bottom end of the stile, a hollow inner member rotatably received in the outer member and adapted to be mounted astraddle the sill rail of the doorframe, and a roller rotatably mounted in the inner member for rolling engagement with the sill rail. Also included is a bearing washer which is disposed within the outer member and through which the outer member bears on the inner member for swivelling motion relative to same.

A feature of the invention resides in the bearing washer interposed between outer and inner members to permit smooth relative swivelling motion thereof in spite of a considerable vertical load to be exerted on the roller assembly by the folding door. The bearing washer is much simpler and less expensive than ball bearings or the like heretofore employed for the same purpose and, further, is free from the trouble of rusting. Still further, since the bearing washer is completely enclosed by the outer and inner members, there is absolutely no possibility of the washer being damaged or malfunctioning through instrusion of foreign matter. The useful life of the swivel roller assembly is thus markedly extended.

The above and other objects, features and advantages of this invention and the manner of attaining them will become more clearly apparent, and the invention itself will best be understood, from the following description and appended claims, taken together with the accompanying drawings showing a preferred embodiment of the invention.

DESCRIPTION OF THE PREFERRED EMBODIMENT

Figure 1:
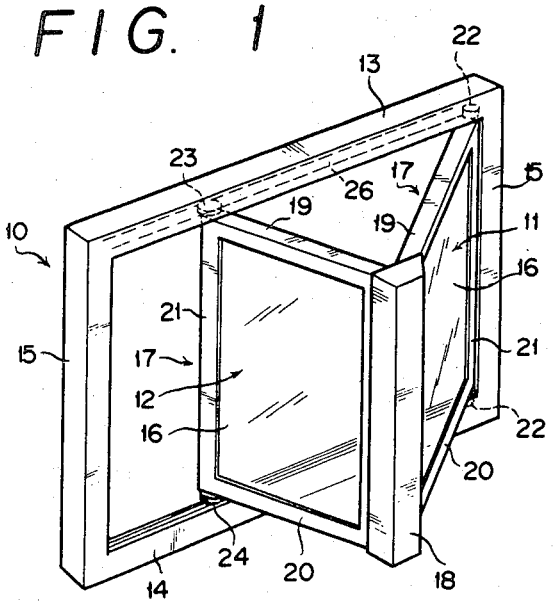
FIG. 1 is a perspective view of the folding door incorporating the swivel roller assembly of this invention.

An example of folding doors shown in FIG. 1, which is considered particularly suitable for use with the swivel roller assembly of this invention, broadly comprises a doorframe 10 defining a doorway in an enclosing wall, and two foldable door sections 11 and 12 mounted within the doorframe to openably close the doorway. The doorframe 10 comprises a header 13 and sill 14 at the top and bottom and side jambs 15 secured at their ends to the header and sill in any convenient fashion.

Each of the door sections 11 and 12 comprises a panel 16 of suitable material and a frame 17 surrounding the panel. The frames 17 of both door sections 11 and 12 share a central crossbar or mullion 18 through which the door sections are foldably hinged together. Further included in each door section frame 17 are top and bottom horizontal members or rails 19 and 20 and a stile 21 at one of the opposite sides of the door sections.

The stile 21 of the right hand door section 11, as seen in FIG. 1, is hinged as at 22 to one of the doorframe jambs 15. This particular door section 11 is therefore swingable on the hinges 22 out of and back to the plane of the doorframe 10 during the opening and closing of the door. As will be noted from FIG. 1, in which the door sections 11 and 12 are shown in a partly open position within the doorframe 10, the stile 21 of the left hand door section 12 is required to move in the plane of the doorframe 10 while permitting the swinging motion of the door section 12. For the fulfillment of this dual requirement, the left hand door section stile 21 is provided with a roller 23 at its top end and with the swivel roller assembly 24 of this invention at its bottom end.

Figure 2:
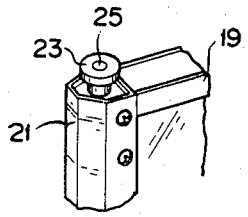
FIG. 2 is an enlarged, partial perspective view showing in particular a roller mounted on the top end of the opening side stile of the folding door of FIG. 1.

As depicted on an enlarged scale in FIG. 2, the roller 23 is rotatably mounted on a pivot pin 25 extending upwardly from the top end of the left hand door section stile 21. The roller 23 makes rolling engagement with a track 26 of inverted U-shaped cross section formed on the underside of the doorframe header 13.

Figure 3:
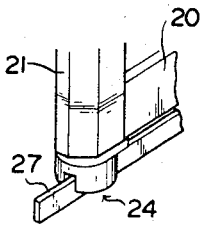
FIG. 3 is an enlarged, partial perspective view showing in particular the swivel roller assembly of this invention as mounted at the bottom end of the opening side stile of the folding door of FIG. 1.

The configuration of the exemplified folding door as so far described is conventional, and therein lies no feature of this invention. The invention is specifically directed to the improved construction of the swivel roller assembly 24 mounted at the bottom end of the left hand door section stile 21 for rolling engagement with an upstanding rail 27 on the doorframe sill 14, as shown on an enlarged scale in FIG. 3. This swivel roller assembly 24 will hereinafter be described in detail with reference to FIGS. 4 through 8.

Figure 4:
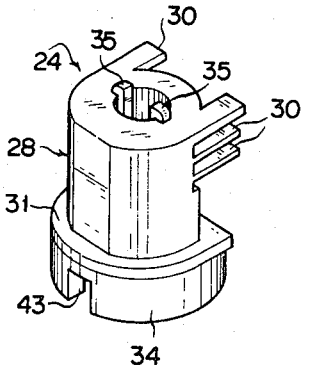
FIG. 4 is a still more enlarged perspective view showing the swivel roller assembly of FIG. 3 in its entirety.
Figure 5:
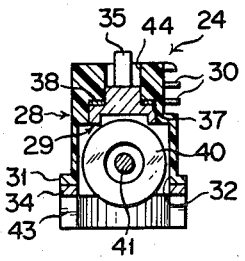
FIG. 5 is a vertical sectional view of the swivel roller assembly.
Figure 6:
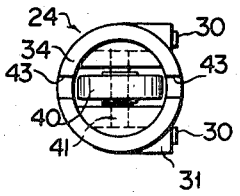
FIG. 6 is a bottom plan view of the swivel roller assembly.

As will be seen from FIGS. 4, 5 and 6, the swivel roller assembly 24 broadly comprises a hollow outer member 28 to be pressed into the left hand door section stile 21, and a hollow inner member 29 rotatably nested in the outer member. Preferably molded from a rigid synthetic resin, the outer member 28 is shown to be substantially semicylindrical in shape. A pair of groups of vertically spaced, resilient fins 30 are molded integral with and project laterally from the outer member 28 for frictional engagement with the inside surface of the left hand door section stile 21. A bottom flange 31 is also molded integral with the outer member 28. The hollow 32 formed in the outer member 28 is cylindrical in shape and is reduced stepwise in diameter as it extends upwardly.

Figure 7:
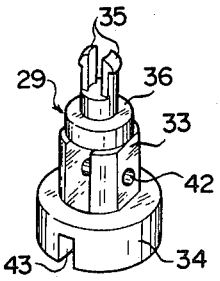
FIG. 7 is a perspective view of the hollow inner member of the swivel roller assembly.
Figure 8:
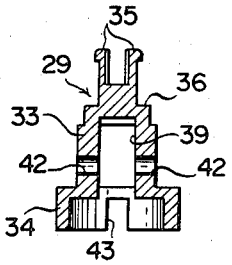
FIG. 8 is a vertical sectional view of the hollow inner member of the swivel roller assembly.

FIGS. 7 and 8 are illustrations of the hollow inner member 29 as detached from within the outer member 28. The inner member 29 comprises a body 33 to be rotatably received in the hollow 32 of the outer member 28, an enlarged base 34 at the bottom end of the body, and a pair of opposed retainer hooks 35 extending upwardly from the body to prevent accidental detachment of the inner member from the outer member.

Substantially cylindrical in shape, the inner member body 33 is reduced stepwise in its outside diameter as it extends upwardly, in conformity with the shape and size of the outer member hollow 32 in which the body is to be slidably received. The uppermost external annular shoulder or step 36 of this inner member body 33 is intended to provide a seat for a bearing washer 37, as of smooth-finished stainless steel, as will be seen by referring back to FIG. 5. The corresponding internal annular step 38 of the outer member 28 bears on this bearing washer 37, as will be detailed subsequently.

The inner member body 33 has formed therein a hollow 39 of shape and size suitable for accommodating a roller 40 with substantial clearance. The roller 40 is rotatably mounted on a pivot pin 41 having its opposite ends engaged in a pair of bores 42 formed in the inner member body 33.

The enlarged base 34 of the inner member 29 is shown to be cylindrical in shape and, in the assembled swivel roller assembly, projects downwardly from the outer member 28. The outer member bottom flange 31 is in sliding contact with this inner member base 34. A pair of downwardly open slots 43 are formed in the inner member base 34 in alignment with the roller 40. As will be best understood from FIG. 3, these aligned slots 43 are intended to receive the sill rail 27 of the doorframe 10 and hence to establish the rolling engagement of the roller 40 with the sill rail.

Extending upwardly from the inner member body 33, the pair of opposed retainer hooks 35 project upwardly of the outer member 28 through its reduced diameter hollow portion 44. The retainer hook pair 35 is further held in sliding engagement with the top end of the outer member 28. Thus, the inner member 29 is prevented from the accidental detachment from within the outer member 28, prior to the installation of this swivel roller assembly 24 under the left hand door section stile 21, but is nevertheless allowed to rotate relative to the outer member.

The swivel roller assembly 24 of the foregoing construction can be readily assembled as the inner member 29, together with the bearing washer 37 seated on its annular step 36, is inserted into the outer member 28. During their passage through the reduced diameter hollow portion 44 in the outer member 28, the pair of retainer hooks 35 are resiliently compressed toward each other and, upon full insertion of the inner member 29 into the outer member, spring back to properly engage the top end of the latter.

Thus, with the swivel roller assembly 24 installed under the left hand door section stile 21, the folding door of FIG. 1 can be opened and closed by folding and unfolding its sections 11 and 12 at the central crossbar 18. During such opening and closing of the folding door, the outer member 28 of the swivel roller assembly 24 swivels with the left hand door section stile 21 relative to the inner member 29, whereas the roller 40 rolls along the sill rail 27 as guided by the inner member mounted astraddle the sill rail. The outer member 28 will smoothly swivel around the inner member 29 by virtue of the bearing washer 37 installed therebetween, in spite of the vertical load exerted on the swivel roller assembly 24 by the folding door. It will also be appreciated that the swivel roller assembly 24 is not to be easily displaced with respect to the left hand door section stile 21 because the groups of resilient fins 30 of the roller assembly are held in frictional engagement with the inside surface of the stile.

It is clear from the foregoing that the invention is well calculated to fulfill the objects set forth herein. Since, however, numerous modifications or changes of the invention will readily occur to those skilled in the art on the basis of this disclosure, it is intended that all matter described herein and shown in the accompanying drawings shall be interpreted as illustrative and not in a limiting sense.

What is claimed is:

1. In a folding door having a plurality of foldable door sections mounted within a doorframe, one of the door sections including a stile which is movable in the plane of the doorframe during the opening and closing of the door, a swivel roller assembly adapted to be mounted at the bottom end of the stile for permitting same both to move along a rail on the sill of the doorframe and to swivel relative to the sill rail, comprising:

(a) a hollow outer member adapted to be immovably received in the bottom end of the stile;

(b) a bearing washer within the outer member;

(c) a hollow inner member rotatably received in the outer member and adapted to be mounted astraddle the sill rail of the doorframe, the outer member bearing on the inner member via the bearing washer for swivelling motion relative to same; and (d) a roller rotatably mounted within the inner member for rolling engagement with the sill rail, said inner member having a portion projecting downwardly of the outer member with a pair of downwardly open slots therein in alignment with the roller and receiving the sill rail.

2. The swivel roller assembly according to claim 1, wherein the outer member is provided with a plurality of resilient fins projecting laterally therefrom for frictional engagement with the inside surface of the stile.

3. The swivel roller assembly according to claim 1, wherein the inner member has formed thereon an external annular step for seating the bearing washer, and wherein the outer member has correspondingly formed thereon an internal annular step which bears on the bearing washer.

4. The swivel roller assembly according to claim 1, wherein the projecting portion of the inner member is enlarged.

5. The swivel roller assembly according to claim 4, wherein the outer member has formed at its bottom end a flange overlying the enlarged projecting portion of the inner member.

6. The swivel roller assembly according to claim 1, wherein the inner member has a pair of retainer hooks extending upwardly therefrom through an opening formed in the outer member and slidably engaged with the top end of the latter, whereby the inner member is restrained from accidental detachment from the outer member but is allowed to rotate relative to same.

* * * * *